US010661322B2

(12) United States Patent
Moden

(10) Patent No.: US 10,661,322 B2
(45) Date of Patent: May 26, 2020

(54) METHOD AND CONTROL SYSTEM FOR TUNING FLATNESS CONTROL IN A MILL

(71) Applicant: ABB Schweiz AG, Baden (CH)

(72) Inventor: Per-Erik Moden, Vasteras (SE)

(73) Assignee: ABB Schweiz AG, Baden (CH)

( * ) Notice: Subject to any disclaimer, the term of this patent is extended or adjusted under 35 U.S.C. 154(b) by 1147 days.

(21) Appl. No.: 14/779,444

(22) PCT Filed: Mar. 5, 2014

(86) PCT No.: PCT/EP2014/054258
§ 371 (c)(1),
(2) Date: Sep. 23, 2015

(87) PCT Pub. No.: WO2014/154456
PCT Pub. Date: Oct. 2, 2014

(65) Prior Publication Data

US 2016/0052032 A1 Feb. 25, 2016

(30) Foreign Application Priority Data

Mar. 25, 2013 (EP) ..... 13160822

(51) Int. Cl.
*B21B 37/28* (2006.01)
*B21B 37/42* (2006.01)

(52) U.S. Cl.
CPC ..... *B21B 37/28* (2013.01); *B21B 37/42* (2013.01)

(58) Field of Classification Search
CPC ..... B21B 37/28; B21B 37/42
See application file for complete search history.

(56) References Cited

U.S. PATENT DOCUMENTS 5,680,784 A 10/1997 Tateno et al.
5,930,136 A 7/1999 Nakajima et al.
2007/0271977 A1* 11/2007 Fodor ..... B21B 37/28 72/9.1

(Continued)

FOREIGN PATENT DOCUMENTS

CN 1192949 A 9/1998
CN 1902464 A 1/2007

(Continued)

OTHER PUBLICATIONS

European Search Report Application No. EP 13 16 0822 Completed: Jul. 26, 2013; dated Aug. 5, 2013 6 pages.

(Continued)

*Primary Examiner* — Robert E Fennema
*Assistant Examiner* — Marzia T Monty
(74) *Attorney, Agent, or Firm* — Whitmyer IP Group LLC

(57) ABSTRACT

A method for tuning flatness control for rolling a strip in a mill including rolls controllable by means of a plurality of actuators, which mill is modeled by means of a mill matrix. The method includes: a) obtaining an equivalent movement range for each actuator, b) determining a scaled mill matrix by scaling the mill matrix based on the equivalent movement ranges, and c) obtaining a singular value decomposition of the scaled mill matrix for providing flatness control of the strip by means of the actuators. A computer program and a control system for carrying out the above method are also presented herein.

15 Claims, 3 Drawing Sheets

(56) References Cited

U.S. PATENT DOCUMENTS

| | | | | |
|---|---|---|---|---|
| 2008/0271508 | A1* | 11/2008 | Kruger | B21B 37/28 72/12.3 |
| 2010/0249973 | A1* | 9/2010 | Bergsten | B21B 37/28 700/104 |
| 2012/0253502 | A1 | 10/2012 | Holm et al. | |

FOREIGN PATENT DOCUMENTS

| | | | |
|---|---|---|---|
| CN | 1974039 | A | 6/2007 |
| CN | 101346676 | A | 1/2009 |
| CN | 202290767 | U | 7/2012 |
| DE | 10049260 | A1 | 4/2002 |
| EP | 2505276 | A1 | 10/2012 |
| EP | 2783765 | A1 | 10/2014 |
| JP | 62166009 | A | 7/1987 |
| JP | 4135007 | A | 5/1992 |
| JP | 4138810 | A | 5/1992 |
| JP | 4111910 | A | 4/2015 |
| WO | 9519591 | | 7/1995 |
| WO | 2006132585 | A1 | 12/2006 |
| WO | 2010146615 | A1 | 12/2010 |

OTHER PUBLICATIONS

International Search Report and Written Opinion of the International Searching Authority Application No. PCT/EP2014/054258 Completed: May 16, 2014; dated May 26, 2014 8 pages.

* cited by examiner

METHOD AND CONTROL SYSTEM FOR TUNING FLATNESS CONTROL IN A MILL

FIELD OF THE INVENTION

The present disclosure generally relates to the control of rolling a strip in a mill, and in particular to a method for tuning flatness control for rolling a strip, and to a control system and computer program for carrying out the method.

BACKGROUND OF THE INVENTION

Strips such as steel strips, or strips made of other metals, can be subjected to a thickness reduction process e.g. by cold rolling or hot rolling in a mill. The work piece, i.e. the strip, is uncoiled from an uncoiler, processed in the mill, and coiled onto a coiler.

A mill comprises rolls with one set of rolls being arranged above the strip and another set of rolls being arranged below the strip when the strip passes through the mill. The mill is arranged to receive the strip between two work rolls forming a roll gap. The remaining rolls provide additional control and pressure to the work rolls, thereby controlling the roll gap profile and hence the flatness of the strip as it moves through the roll gap.

A cluster mill for example comprises a plurality of rolls stacked as layers above and below the work rolls. Backup rolls, i.e. the uppermost rolls of the rolls arranged above the roll gap and the lowermost rolls of the rolls arranged below the roll gap, may be segmented. Each roll segment may be moved in and out of the mill by means of crown actuators. The movements of the segmented rolls permeate through the cluster of rolls toward the work rolls for forming the strip moving through the roll gap. The remaining rolls of the cluster mill may also be actuated by means of their respective actuators. Bending actuators may for instance provide bending effects to a roll to which they are assigned and thereby change the profile of the roll gap. Side-shift rolls may have non-cylindrical shape which alters the roll gap profile by means of axial displacement of the side-shift rolls via side-shift actuators.

A uniform flatness across the width of the strip is typically desired as a non-uniform flatness may e.g. result in the manufacture of a strip having lower quality than a strip having an essentially uniform flatness profile. A strip having non-uniform flatness may for instance become buckled or partially corrugated. Non-uniform flatness may also cause strip breaks due to locally increased tension. Therefore, the flatness profile of the strip is measured, e.g. by measuring the force applied by the strip to a measurement roll, prior to the strip is coiled onto the coiler, wherein the measured flatness data is provided to a control system which controls the actuators of the mill for controlling the roll gap of the mill such that uniform flatness of the strip may be obtained. In order to control the actuators, the mill is generally modeled by means of a flatness response function for each of the actuators of the mill. These can for example be gathered as columns in a matrix, sometimes referred to as the mill matrix, $G_m$.

In a mill having a plurality of actuators, such as a cluster mill, one may have linear dependence among the flatness responses. This means that there may be actuator position combinations which do not affect the flatness of the strip because the combined flatness response provided by the actuators cancel the flatness effects provided by each individual actuator. For mills in which the above-described situation may arise, the corresponding mill matrix is said to be singular. In mathematical terms, a singular mill matrix does not have full rank, i.e. the mill matrix null space has a dimension greater than zero.

A classical control approach involves one control loop per actuator, with the flatness error vector projected to one value per control loop. For mills having a singular mill matrix this leads to such movement of the actuators that in some cases the flatness of the strip will not be affected, because the error projection allows all possible actuator position combinations. This corresponds to actuator movement in the null space of the mill matrix. Repeated disturbances will cause the actuators to drift along the directions which do not directly influence the flatness. There is also a risk that these actuator movements get far too large. These two cases of unwanted behavior may cause the actuators to saturate, but also cause unnecessary actuator load and wear.

In order to address this problem, the mill matrix $G_m$ may be represented in the form of its singular value decomposition $G_m=U\Sigma V^T$. The singular values of $G_m$, which form the diagonal of $\Sigma$ obtained from the singular value decomposition, provide information of the magnitude of the flatness response provided by each of the actuator position combinations, as defined by the column vectors of the orthonormal matrix V to flatness shapes as defined by the columns of the orthonormal matrix U. Moreover, the singular value decomposition provides information regarding actuator positions which do not directly influence the flatness profile of the roll gap, i.e. the null space.

By parameterizing the flatness error using the flatness response in the directions which do influence the flatness, and by mapping the controller outputs utilizing only those directions which do influence the flatness, movement of actuators in directions which do not influence the flatness may be blocked. Thus, actuator position combinations which do not affect the flatness profile of the roll gap will be avoided. By utilizing singular value decomposition to avoid combinations of the actuator positions which do not affect the flatness of the strip, not all degrees of freedom of control will be available for control in the sense that some combinations of actuator positions will not be allowed. Therefore control performance may suffer. Moreover, it may also be difficult to tune the separate control loops satisfyingly, since each control loop involves several actuators and therefore have more complex dynamics. EP2505276 addresses these problems by determining an adjusted flatness error based on the measured flatness error and weights for actuator positions which provide a flatness effect below a threshold value. Hence, in some situations the actuator position combinations which correspond to vectors in the null space of the model may be allowed. Thereby all possible actuator position combinations, i.e. all degrees of freedom of the control system which implements the method can be utilized.

Although singular value decomposition based flatness control has proved to be efficient, it is important to tune the process correctly in order to obtain successful flatness control.

SUMMARY OF THE INVENTION

A general object of the present disclosure is to improve flatness control when rolling a strip in a mill. In particular, it would be desirable to provide a method and control system for tuning the flatness control.

Hence, according to a first aspect of the present disclosure there is provided a method for tuning flatness control for rolling a strip in a mill comprising rolls controllable by means of a plurality of actuators, which mill is modeled by means of a mill matrix, wherein the method comprises:

a) obtaining an equivalent movement range for each actuator, b) determining a scaled mill matrix by scaling the mill matrix based on the equivalent movement ranges, and c) obtaining a singular value decomposition of the scaled mill matrix for providing flatness control of the strip by means of the actuators.

By an actuator is generally meant a set of actuators which control one roll or a roll segment of a segmented roll, such as a backup roll.

The scaling is based on a user-tunable parameter, i.e. the equivalent movement range, which is the size of actuator movement that the commissioning engineer responsible for the tuning would feel comfortable with. This movement size may also have an effect on the flatness, roughly comparable in size to that of the other actuators. The equivalent movement range of each actuator in some sense characterizes how large movement of the actuators are considered to be equivalent, generally not in the sense that they provide the same flatness effect, but rather in that they are equally accepted by the mill. The equivalent movement ranges indicate roughly the ranges that the different actuators are expected to cover in their normal control actions, and they may thus also be viewed as preferred control ranges.

The singular value decomposition of the scaled mill matrix gives different singular values than the original mill matrix, and in particular different ratios between the individual singular values. This affects the condition number of the part that is non-singular, i.e. those directions associated with a singular value that is above a predetermined threshold value, and influences the possibility for the control to perform well. When the scaling is changed and thus also the singular value decomposition is changed, not only the singular values are influenced, but also the two sets of basis vectors formed by the columns of the matrices U and V, respectively, in the decomposition $G=U\Sigma V^T$. This means that a different combination of actuator movements will be used for e.g. the first direction, and the corresponding flatness error will also be different. The influence on how much each actuator is used is in fact an object of the tuning when the equivalent movement ranges are used as tuning parameters.

Thus, by means of the present disclosure, by sensibly selecting the scaling of the mill matrix, a good basis for flatness control utilizing singular value decomposition may be obtained. Moreover, the tuning procedure is easy to grasp for users and provides quick and efficient tuning at commissioning as well as service occasions.

Actuator scaling together with singular value decomposition of the mill matrix is practically applicable to a control solution with model predictive control as well as to a control solution where the distribution of the flatness error to one controller per actuator is based on an optimization condition.

According to one embodiment each equivalent movement range is an element of a vector.

One embodiment comprises determining a scaling factor based on the equivalent movement ranges, wherein step b) comprises scaling the mill matrix with the scaling factor.

According to one embodiment the scaling factor is a diagonal matrix with its diagonal being formed by a diagonal matrix having as its diagonal elements the equivalent movement ranges.

According to one embodiment in step a) the equivalent movement range for each actuator is obtained via user input of each equivalent movement range.

One embodiment comprises d) determining a ratio of a largest singular value and a singular value that is larger than a predetermined flatness effect threshold value, of the scaled mill matrix, and repeating steps a) to d) until a minimum ratio is obtained. The condition number of the non-singular part may hence be minimized, whereby more robust control may be obtained. If for example the goal is to control n different directions well, then the ratio of the singular values $\sigma 1/\sigma_n$ should not be too large.

According to one embodiment the largest singular value is the numerator and the singular value larger than a predetermined flatness effect threshold value is the denominator of the ratio.

According to a second aspect there is provided a computer program comprising computer-executable components which when loaded onto a processing system of a control system performs the steps of the first aspect. The computer program may for example be stored in a memory or other computer readable means as software.

According to a third aspect of the present disclosure there is provided a control system for providing flatness control for rolling a strip in a mill comprising rolls controllable by means of a plurality of actuators, which control system utilizes a mill matrix to model of the mill, wherein the control system comprises: a processing system arranged to: obtain an equivalent movement range for each actuator; determine a scaled mill matrix by scaling the mill matrix based on the equivalent movement ranges; and obtain a singular value decomposition of the scaled mill matrix for providing flatness control of the strip by means of the actuators.

According to one embodiment each equivalent movement range is an element of a vector.

According to one embodiment the processing system is arranged to determine a scaling factor based on the equivalent movement ranges, and to scale the mill matrix with the scaling factor.

According to one embodiment the scaling factor is a diagonal matrix having as its diagonal elements the equivalent movement ranges.

According to one embodiment the processing system is arranged to obtain each equivalent movement range from a user input.

According to one embodiment the processing system is arranged to determine a ratio of a largest singular value and a singular value that is larger than a predetermined flatness effect threshold value, of the scaled mill matrix, wherein the processing system is arranged to repeat: to obtain an equivalent movement range for each actuator, to determine a scaled mill matrix by scaling the mill matrix based on the equivalent movement ranges, to obtain a singular value decomposition of the scaled mill matrix for providing flatness control of the strip by means of the actuators, and to determine a ratio of a largest singular value and a singular value that is larger than a predetermined flatness effect threshold value until a minimum ratio is obtained.

According to one embodiment the largest singular value is the numerator and the singular value that is larger than a flatness effect threshold value is the denominator of the ratio.

Additional features and advantages will be disclosed in the following.

BRIEF DESCRIPTION OF THE DRAWINGS

The invention and the advantages thereof will now be described by way of non-limiting examples, with reference to the accompanying drawings of which.

DETAILED DESCRIPTION OF THE INVENTION

Figure 1:
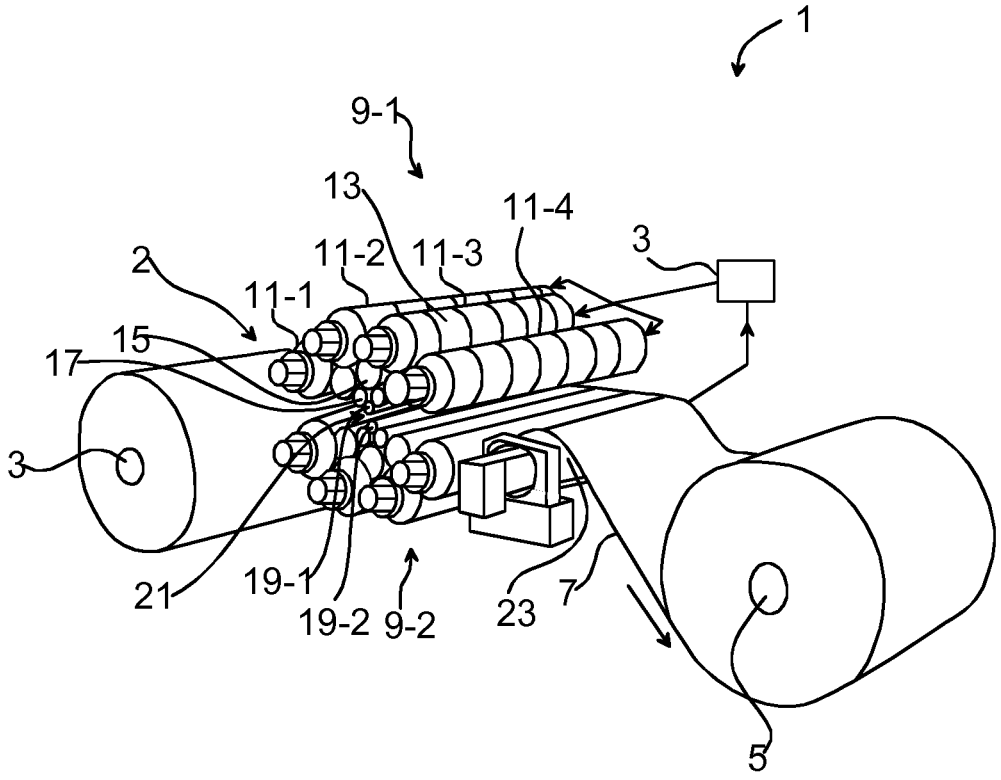
FIG. 1 is a perspective view of an example of a cluster mill.

FIG. 1 shows a perspective view of an example of a roll arrangement 1. The exemplified roll arrangement 1 comprises a cluster mill 2, an uncoiler 3 and a coiler 5. The cluster mill 2, hereafter referred to as mill 2, may be used for rolling hard materials, e.g. for cold rolling a metal strip.

A strip 7 may be uncoiled from the uncoiler 3 and coiled onto the coiler 5. The strip 7 is subjected to a thickness reduction process by means of the mill 2 as the strip 7 moves from the uncoiler 3 to the coiler 5.

The mill 2 comprises a plurality of rolls 9-1 and 9-2, including work rolls 19-1 and 19-2, respectively. The rolls 9-1 form a cluster of upper rolls above the strip 7. The rolls 9-2 form a cluster of lower rolls below the strip 7. The exemplified mill 2 is a 20-high mill with the rolls 9-1 and 9-2 arranged in a 1-2-3-4 formation above and below the strip 7, respectively. It is however to be noted that the present invention is likewise applicable to other types of mills such as 6-high and 4-high mills.

Each roll may be actuated by means of actuators (not shown) in order to deform the work rolls 19-1 and 19-2 and thereby adjust a roll gap 21 which is formed between the work rolls 19-1 and 19-2. The process of thickness reduction the strip 7 is obtained when the strip passes the roll gap 21. The work rolls 19-1 and 19-2 are hence in contact with the strip 7 when the strip 7 moves through the mill 2.

Each of the plurality of rolls 9-1 and 9-2 comprise backup rolls, such as backup rolls 11-1, 11-2, 11-3 and 11-4, forming an outer set of rolls of the mill 2. Each backup roll is segmented into a plurality of segments 13. Each of the segments 13 may be controlled by actuators. The segments 13 may by means of actuators be moved towards, or away from, the work rolls 19-1, 19-2. The movement of the rotating segments 13 permeates through the cluster of rolls toward the work roll 19-1 and/or work roll 19-2 for forming the strip 7 moving through the roll gap 21.

In order to provide additional control of the thickness reduction process of the strip 7, the rolls 9-1 and 9-2 further comprise intermediate rolls 15 and 17 arranged between the work rolls 19-1, 19-2 and the backup rolls 11-1, 11-2, 11-3, 11-4. The intermediate rolls 15 and 17 may for instance have bending actuators and/or side-shift actuators, respectively.

The roll arrangement 1 further comprises a measurement device 23, exemplified herein by a measurement roll. The measurement device 23 has an axial extension which is wider than the width of the strip 7 to enable force measurement along the width of the strip 7.

The measurement device 23 comprises a plurality of sensors. The sensors may for instance be distributed in openings in the peripheral surface of the measurement device for sensing the forces applied by the strip to the measurement device. As the strip 7 moves over the measurement device 23, a strip tension profile may by means of the sensors be obtained. A strip tension profile having an even force distribution indicates that the strip has a uniform flatness along its width. A strip tension profile which is non-uniform indicates that the strip has a non-uniform flatness along its width at the associated measured position of the strip.

The measured strip tension profile, translated into a deduced flatness profile, is provided by the measurement device 23 as measurement data to a control system 3.

The measurement data is processed by the control system 3 for controlling the rolls 9-1 and 9-2 by means of the actuators of the mill 2 to thereby provide uniform flatness or a target flatness along the width of the strip 7.

Figure 2:
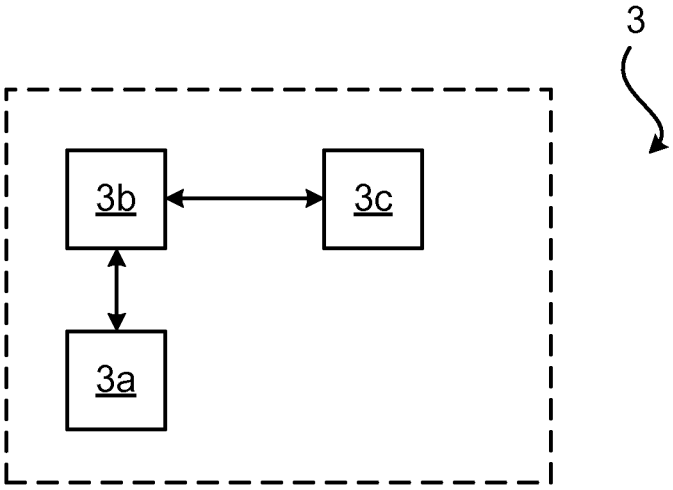
FIG. 2 is a block diagram of a control system.

FIG. 2 depicts a schematic block diagram of control system 3. The control system 3 may for example be a multivariable model predictive controller, or it may comprise one control loop for each actuator realized by means of respective PI controllers.

The control system 3 comprises an input/output unit (I/O) 3*a*, a processing system 3*b* and a memory 3*c*. The I/O unit 3*a* is arranged to be connected to the roll arrangement which it is to control. The control system 3 is arranged to receive measurement data from a measurement device via the I/O unit 3*a*, and to control the actuators via the I/O unit 3*a*. The memory 3*c* is arranged to store a model of the mill arrangement that the control system 3 is intended to control, and other computer-executable components for tuning flatness control. The model comprises a mill matrix $G_m$. The I/O unit 3*a* may also be arranged to be connected to an input device such as a mouse or a keyboard, and to a display device adapted to display a user interface to users, such as commissioning engineers, such that tuning of the actuators may be performed by means of the control system 3.

Figure 3A:
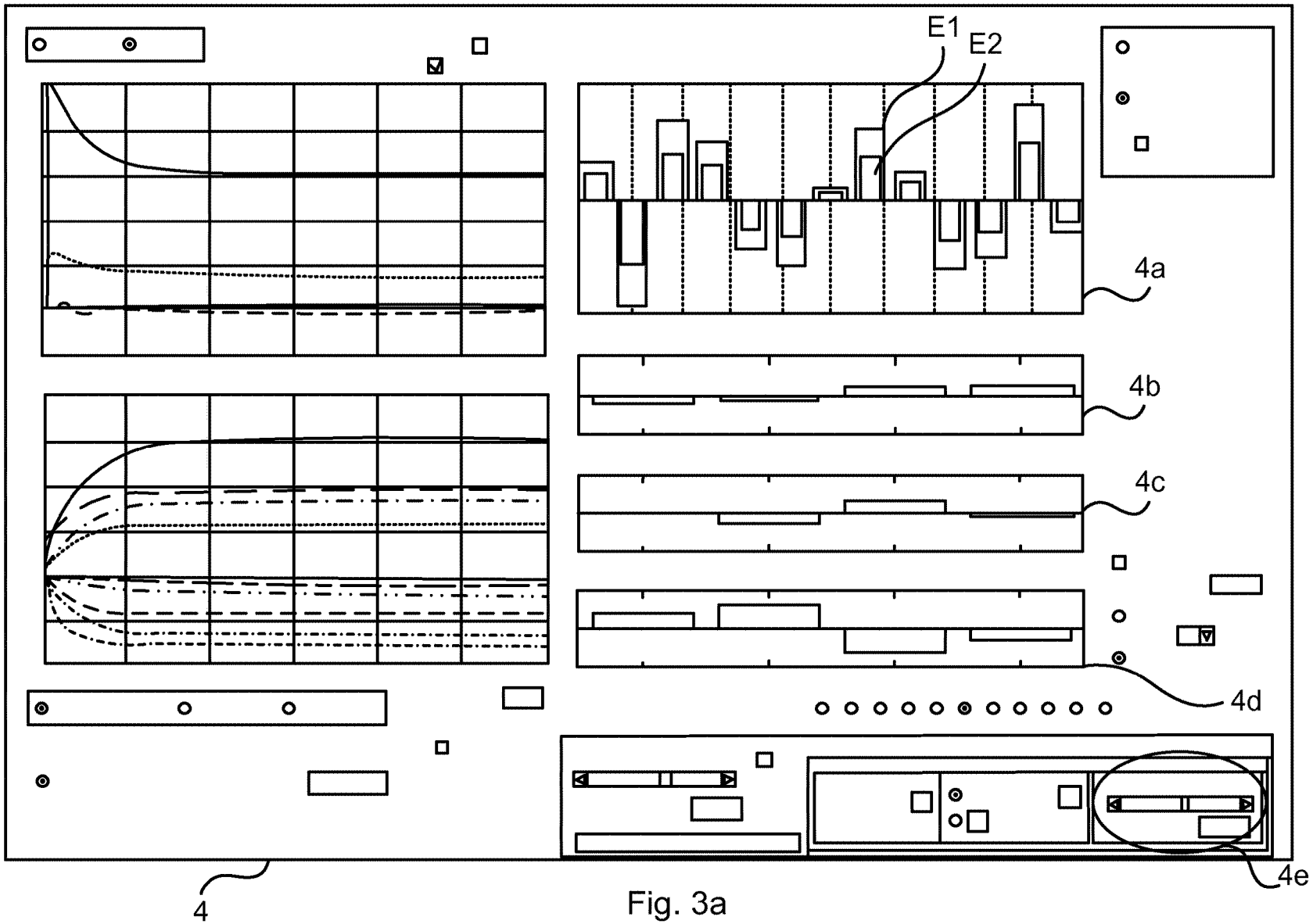
FIG. 3*a* is an example of a user interface for tuning flatness control in a cluster mill.
Figure 3B:
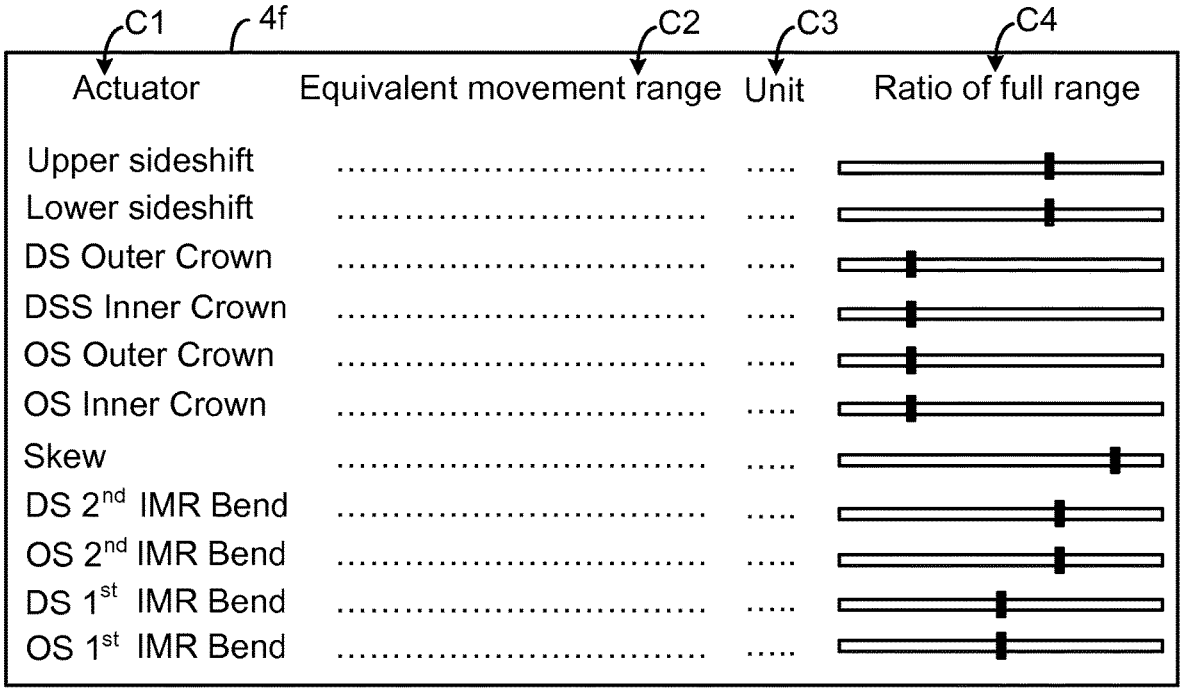
FIG. 3*b* is an example of an equivalent movement range window of the user interface in FIG. 3*a* for selecting actuator movement ranges.

A method for tuning flatness control will now be described in more detail in the following with reference to FIGS. 3*a-b* and 4. FIG. 3*a* shows an example of a user interface 4 in which a first window 4*a* displays each pre-control flatness errors E1 as measured by the sensors of the measurement device, and each post-control flatness error E2 measured after actuator control has been initiated and the response has settled. According to the example, a second window 4*b* displays the actuator movements of crown actuators for obtaining the post-control flatness errors E2. A third window 4*c* displays the actuator movements of bend actuators for obtaining the post-control flatness errors E2. A fourth window 4*d* displays actuator movements of sideshift and skew actuators for obtaining the post-control flatness errors E2. Furthermore, an actuator tuning window 4*e* is displayed in the user interface 4. According to the example, a user may select the actuator tuning window 4*e* in order to open an equivalent movement range window 4*f*, as shown in FIG. 3*b*. The equivalent movement range window 4*f* allows a user to change the equivalent movement range of the actuators. A first column C1 indicates the actuators of the mill, which according to the present example has eleven actuators. A second column C2 indicates the equivalent movement ranges of the actuators. A value for each equivalent movement range may be selected by a user. The control system may thus receive user inputs of equivalent movement ranges via entry in the second column C2. A third column C3 may indicate the unit of each equivalent movement range, expressed in for example millimeter, or MPa in case of a hydraulic actuator. According to the example, a fourth column C4 indicates how large portion of the full range of movement each actuator is given as equivalent movement range. The equivalent movement range may for example correspond to 100% of the desired actuator movement span, i.e. the magnitude of a desired range of allowable actuator movement, or it may correspond to e.g. 2% or 1% of the desired actuator movement span.

The equivalent movement range of each actuator in some sense characterizes how large movement of the actuators are considered to be equivalent, generally not in the sense that they provide the same flatness effect, but rather in that they are equally accepted by the mill. The equivalent movement ranges indicate roughly the ranges that the different actuators are expected to cover in their normal control actions, and they may thus also be viewed as preferred control ranges. But what matters in practice is only the relation between the equivalent movement ranges given to the different actuators. The equivalent movement range of an actuator may be a numeric value which is based on the actual physical range of allowed movement of that actuator. By means of the equivalent movement range window 4*e*, a user may select the equivalent movement ranges for the actuators. The user may observe simulations of flatness error control in windows 4*a*-4*d* based on the equivalent movement ranges selected, before deciding whether the selected equivalent movement ranges for the actuators is acceptable and is to be utilized for flatness control in the mill.

Figure 4:
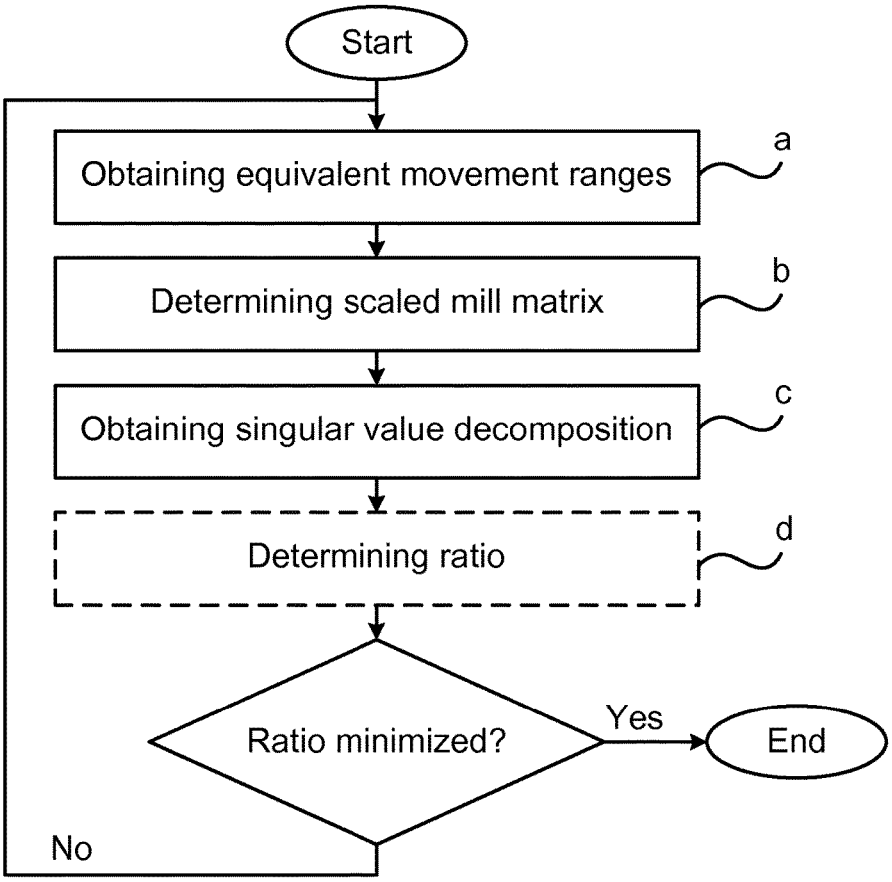
FIG. 4 is a flow chart illustrating a method for tuning flatness control for rolling a strip in a mill comprising a plurality of rolls controllable by means of actuators.

FIG. 4 depicts a flow chart illustrating the flatness control tuning method in more detail. In a step a) an equivalent movement range for each actuator is obtained by the processing system 3*b*. The equivalent movement range for each actuator may for example be obtained by way of a user input via the user interface 4. Such a user input may for example be effected via the equivalent movement range window 4*e*.

Each obtained equivalent movement range is an element of a vector $p_a$. Each element of the vector $p_a$ is hence associated with a respective actuator and there is hence a one-to-one correspondence between the actuators and the coordinates of the vector.

In a step b) a scaled mill matrix $G_s$ is determined by the processing system 2*b* of the control system 3 by scaling the mill matrix $G_m$ obtained from the memory 3*c*. The scaling is based on the equivalent movement ranges. The scaling of the mill matrix $G_m$ in step b) may be obtained by determining a scaling factor $g^{-1}$ based on the equivalent movement ranges $p_a$ and scaling the mill matrix $G_m$ with the scaling factor $g^{-1}$. Typically the scaling of the mill matrix $G_m$ is obtained by multiplying the scaling factor $g^{-1}$ with the mill matrix $G_m$. According to one variation the scaling involves multiplying the mill matrix $G_m$ from the right with the scaling factor $g^{-1}$, i.e. $G_s=G_m*g^{-1}$. The scaling factor $g^{-1}$ may be a diagonal matrix with its diagonal having as its diagonal elements the equivalent movement range of each actuator, as shown in equation (1) below.

$$g^{-1}=\mathrm{diag}(p_a) \tag{1}$$

The scaling factor $g^{-1}$ is the inverse of $g=(\mathrm{diag}(p_a))^{-1}$ and can be derived as follows. Let $u_a$ denote the actuator positions expressed in original units. Then the actuators scaled by means of the equivalent movement ranges $p_a$ can be expressed $u_s=g*u_a$. Then the following relations hold.

$$G_m*u_a=G_m*g^{-1}*g*u_a=G_m*g^{-1}*u_s=G_s*u_s \tag{2}$$

where $G_s=G_m*g^{-1}$, i.e. the mill matrix $G_m$ is scaled by means of $g^{-1}$.

In a step c) a singular value decomposition of the scaled mill matrix $G_s$ is obtained by the processing system 3*b*. The scaled mill matrix $G_s$ may be utilized for providing flatness control of the strip by means of the actuators. In particular, the above-described tuning can be utilized in control systems comprising multivariable model predictive controllers or PI controllers.

The singular value decomposition form of the scaled mill matrix $G_s$ may be expressed as follows.

$$G_s = U\sum V^T = [\,U_1 \quad U_2\,]\begin{bmatrix}\sum_1 & 0\\ 0 & \sum_2\end{bmatrix}\begin{bmatrix}V_1^T\\ V_2^T\end{bmatrix} \approx U_1\sum_1 V_1^T \tag{3}$$

The matrix $\Sigma$ is diagonal with the singular values of $G_s$ in its diagonal, with the largest singular value first, and arranged in decreasing order. The matrix $U_1$ is associated with the flatness effects provided by specific actuator position combinations, i.e. actuator configurations, which do provide a flatness effect to the roll gap and which are defined by the row vectors of the matrix $V_1^T$. Each direction of the matrix $V_1^T$, i.e. each row vector, thus represents a specific actuator position combination. The singular values which form the diagonal of the matrix $\Sigma_1$ represent the magnitude of the flatness effect for the actuator position combinations of the matrix $V_1^T$.

The matrix $V_2$ is associated with those actuator position combinations which do not provide any flatness effect and the singular values which form the diagonal of the matrix $\Sigma_2$ are close to zero or zero. In particular, the column vectors of the matrix $V_2$ span the null space of the mill matrix $G_s$. In practice, the singular values which are seen to be zero for control purposes may be those singular values which are below a predetermined flatness effect threshold value. As an example, singular values which are a factor $10^{-3}$ smaller than the largest singular value may be set to be zero. The column vectors of V which correspond to these singular values are hence defined to span the null space of the mill matrix $G_s$.

According to one variation of the tuning process, a ratio of a largest singular value and a singular value that is larger than a predetermined flatness effect threshold value, of the scaled mill matrix is determined in a step d) by means of the processing system 3*b*. Steps a) to d) may be repeated until the ratio is minimized. The largest singular value is hence the numerator and the singular value that has a predetermined flatness effect threshold value is the denominator of the ratio. This ratio determines the effective condition number which is the ratio between the largest singular value and a singular value which is not associated with a singular direction and which may be equal to or larger than the smallest such singular value. The singular value that is larger than a predetermined flatness effect threshold value may thus for example be the smallest singular value of the non-singular part of the matrix $\Sigma$. However, often the condition number of the matrix $\Sigma_1$, taking the ratio between the largest singular value and the smallest singular value, is far too high. This means that one may have to settle for controlling fewer directions than a number corresponding to the rank of the scaled mill matrix. Thus, the singular value that is larger than a predetermined flatness effect value may be a singular value that is not the smallest singular value of the non-singular part of the matrix $\Sigma$. The singular value that is larger than a predetermined flatness effect value may be selected by the user, for example the commissioning engineer.

As an example, if the mill arrangement has eleven actuators, but a mill matrix of rank only eight, it is theoretically possibly to control eight directions. But the practical condition number, taking the ratio between the largest singular value and the eighth singular value, is probably far too high. This means that one may have to settle for controlling let us say just five directions instead. But the ratio between the first singular value and the fifth singular value will depend on the scaled mill matrix $G_s$, i.e. on the actuator scaling. By minimizing the ratio, a minimum condition number for the non-singular part of the scaled mill matrix $G_s$ may be obtained, whereby more robust control may be provided. Thus, a scaled mill matrix $G_s$ based on equivalent movement ranges which minimizes the effective condition number may be used for flatness control. Alternatively, a scaled mill matrix $G_s$ based on a minimum condition number may be used as initial choice that may be adjusted according to the preferences for the particular case, for example via the equivalent movement range window 4*e*.

As an alternative to step d), in a step d') a ratio of a largest singular value and a user-selected singular may be determined. Steps a) to d') may be repeated until the ratio is minimized. The user-selected singular value need not necessarily be larger than a predetermined flatness effect threshold value. The user-selected singular value may instead be that singular value in the number order of singular values, which corresponds to the number of singular value directions that the user, e.g. the commissioning engineer, would believe to be useful for efficient flatness control.

The scaled mill matrix $G_s$ obtained via optimization by minimizing the ratio between the largest singular value and a singular value that is larger than a predetermined flatness effect threshold value or the ratio between the largest singular value and a user-selected singular value and/or by user selection of the scaling factor may be stored in the memory 3*c* for flatness control.

As noted above, the herein presented tuning process may be utilised both for PI control systems and for multivariable model predictive control which may be implemented in software, in hardware or a combination thereof. In the former case a flatness error e can be determined by means of the processing system by the difference between the reference flatness of the strip and the measurement data. The flatness error e is adjusted to obtain an adjusted flatness error $e_p$. The adjusted flatness error $e_p$ is to be construed as a parameterized flatness error, i.e. the adjusted flatness error $e_p$ is a parameterization of the flatness error e. The adjusted flatness error $e_p$ is determined based on the minimization of for example one of equations (4) and (5) herebelow. The determining of the adjusted flatness error $e_p$ is based on the difference between a mapping of the adjusted flatness error $e_p$ by means of the scaled mill matrix $G_s$, and the flatness error e, while adding costs, i.e. weights, to the adjusted flatness error and the control unit outputs u and respecting constraints to the control unit outputs. Such constraints may for instance be end constraints, i.e. minimum and maximum allowed positions or possible positions of the actuators. Constraints can also relate to rate constraints, i.e. how fast the actuators are allowed to move, or can move. Furthermore, constraints may relate to differences between actuator positions.

The error parameterization may be seen as a projection of the many original measurements onto exactly one measurement per actuator, which is normally a much lower number.

$$e_p(t) = \arg\left(\min_{u(t)\in allowed}(\|G_m e_p(t) - e(t)\|^2 + e_p(t)^T V Q_e V^T e_p(t) + u(t)^T V Q_u V^T u(t))\right) \quad (4)$$

The variable t in equation (4) indicates the time dependence of the flatness error e, the adjusted flatness error $e_p$, and the control unit outputs u. The optimization is described in more detail in EP2505276.

$$e_p(t) = \arg\left(\min_{u(t)\in allowed}\left(\begin{array}{c}(G_m e_p(t) - e(t))^T Z(G_m e_p(t) - e(t)) + \\ e_p(t)^T V Q_e V^T e_p(t) + + u(t)^T V Q_u V^T u(t) + \\ u(t)^T Q_d u(t)\end{array}\right)\right) \quad (5)$$

If a multivariable model predictive controller (MPC) is used instead of PI controllers, the MPC controller also applies a criterion, but in that case for the direct determination in every sampling instant of the manipulated variable u(t) to be sent to the actuators. This criterion can be formulated as $$u(t) = \arg\left(\min_{u(t)\in allowed}\sum_{k=t}^{t+H}[\hat{e}(k)^T Q_1 \hat{e}(k) + u(k)^T Q_2 u(k)]\right) \quad (6)$$

where H is the horizon and $\hat{e}(k)$ is the predicted flatness error at sampling instant k. Also when an MPC solution is used, the singular value decomposition of the scaled mill matrix $G_s$ can be used in tuning of the control. Since actuator movement in directions coupled to small singular values are undesired, the weight matrix $Q_2$ should be chosen with help of the singular vale decomposition, rather than the standard choice of a diagonal matrix. With the choice $$Q_2 = V Q_u V^T \quad (7)$$

and a diagonal matrix $Q_u$, tuning parameters associated with the separate singular value directions are obtained. Beneficially large values in the elements of $Q_u$ are selected to be associated with small singular values. Similarly $Q_1$ may be selected as $$Q_1 = U Q_y U^T \quad (8)$$

to be able to set weights on different shapes of the flatness error according to the singular values. In this case, with a diagonal matrix $Q_y$ large values for the elements associated with large singular values may beneficially be selected, since these are the error shapes that are generally desired to be eliminated, and low values for the elements associated with small singular values, as these are considered to be too hard to counteract.

The skilled person in the art realizes that the present invention by no means is limited to the examples described hereabove. On the contrary, many modifications and variations are possible within the scope of the appended claims.

The invention claimed is:

1. A method for tuning flatness control for rolling a strip in a mill comprising rolls controllable by means of a plurality of actuators, which mill is modeled by means of a mill matrix, wherein the method comprises:

displaying an equivalent movement range window allowing a user input to change the equivalent movement ranges of the actuators, the equivalent movement ranges being user-selectable ranges of movement of the actuators within a full range of movement for each actuator, a) obtaining an equivalent movement range for each actuator, b) determining a scaled mill matrix by scaling the mill matrix based on the equivalent movement ranges, and c) obtaining a singular value decomposition of the scaled mill matrix for providing flatness control of the strip by means of the actuators.

2. The method as claimed in claim 1, wherein each equivalent movement range is an element of a vector.

3. The method as claimed in claim 1, comprising determining a scaling factor based on the equivalent movement ranges, wherein step b) comprises scaling the mill matrix with the scaling factor.

4. The method as claimed in claim 3, wherein the scaling factor is a diagonal matrix with its diagonal having as its diagonal elements the equivalent movement ranges.

5. The method as claimed in claim 1, wherein in step a) the equivalent movement range for each actuator is obtained via user input of each equivalent movement range.

6. The method as claimed in claim 1, comprising:

d) determining a ratio of a largest singular value and a singular value that is larger than a predetermined flatness effect threshold value, of the scaled mill matrix and repeating steps a) to d) until a minimum ratio is obtained.

7. The method as claimed in claim 6, wherein the largest singular value is the numerator and the singular value that is larger than a predetermined flatness effect threshold value is the denominator of the ratio.

8. A computer program embodied in a non-transitory computer readable medium, which when loaded onto a processor of a control system are eecuted by the processor, performs the steps of:

displaying an equivalent movement range window allowing a user input to change the equivalent movement ranges of the actuators, the equivalent movement ranges being user-selectable ranges of movement on the actuators within a full range of movement for each actuator, a) obtaining an equivalent movement range for each actuator, b) determining a scaled mill matrix by scaling the mill matrix based on the equivalent movement ranges, and c) obtaining a singular value decomposition of the scaled mill matrix for providing flatness control of the strip by means of the actuators.

9. A control system for providing flatness control for rolling a strip in a mill comprising rolls controllable by means of a plurality of actuators, which control system utilizes a mill matrix to model of the mill, wherein the control system comprises:

a processing system arranged to:

display an equivalent movement range window allowing a user input to change the equivalent movement ranges of the actuators, the equivalent movement ranges being user-selectable ranges of movement of the actuators within a full range of movement for each actuator, obtain an equivalent movement range for each actuator, determine a scaled mill matrix by scaling the mill matrix based on the equivalent movement ranges, and obtain a singular value decomposition of the scaled mill matrix for providing flatness control of the strip by means of the actuators.

10. The control system as claimed in claim 9, wherein each equivalent movement range is an element of a vector.

11. The control system as claimed in claim 9, wherein the processing system is arranged to determine a scaling factor based on the equivalent movement ranges, and to scale the mill matrix with the scaling factor.

12. The control system as claimed in claim 11, wherein the scaling factor is a diagonal matrix having as its diagonal elements the equivalent movement ranges.

13. The control system as claimed in any of claims 9, wherein the processing system is arranged to obtain each equivalent movement range from a user input.

14. The control system as claimed in claim 9, wherein the processing system is arranged to determine a ratio of the largest singular value and a singular value that is larger than a predetermined flatness effect threshold value, wherein the processing system is arranged to repeat:

to obtain an equivalent movement range for each actuator, to determine a scaled mill matrix by scaling the mill matrix based on the equivalent movement ranges, to obtain a singular value decomposition of the scaled mill matrix for providing flatness control of the strip by means of the actuators, and to determine a ratio of a largest singular value and a singular value that is larger than a predetermined flatness effect threshold value until a minimum ratio is obtained.

15. The control system as claimed in claim 14, wherein the largest singular value is the numerator and the singular value that is larger than a predetermined flatness effect threshold value is the denominator of the ratio.

* * * * *